US006896449B1

(12) United States Patent
Callinan et al.

(10) Patent No.: US 6,896,449 B1
(45) Date of Patent: May 24, 2005

(54) RETAINING WALL SYSTEM

(75) Inventors: Garry Callinan, Merewether (AU); Glen Cashman, Charlestown (AU)

(73) Assignee: Ecoflex Australia Pty Limited, New Castle (AU)

( * ) Notice: Subject to any disclaimer, the term of this patent is extended or adjusted under 35 U.S.C. 154(b) by 0 days.

(21) Appl. No.: 09/428,508

(22) Filed: Oct. 27, 1999

(30) Foreign Application Priority Data

Apr. 28, 1997 (AU) ..... PO6452
Jul. 3, 1997 (AU) ..... PO7677
Oct. 21, 1997 (AU) ..... PO9901

(51) Int. Cl.[7] ..... E02D 29/02

(52) U.S. Cl. ..... 405/284; 405/302.4; 405/302.6; 405/15

(58) Field of Search ..... 405/284–286, 405/262, 15–17, 30, 302.6, 302.7, 302.4; 52/DIG. 9

(56) References Cited

U.S. PATENT DOCUMENTS

| | | | | | |
|---|---|---|---|---|---|
| 4,080,793 | A | * | 3/1978 | Pulsifer | 405/30 |
| 4,188,153 | A | * | 2/1980 | Taylor | 405/34 |
| 4,785,577 | A | * | 11/1988 | Lederbauer | 405/284 |
| 5,011,327 | A | * | 4/1991 | Thiac | 405/30 |
| 5,024,560 | A | * | 6/1991 | Reilly | 405/16 |
| 5,056,961 | A | * | 10/1991 | McMeans et al. | 405/284 |
| 5,178,489 | A | * | 1/1993 | Suhayda | 405/284 |
| 5,364,206 | A | * | 11/1994 | Marienfeld | 405/302.6 |
| 5,370,475 | A | * | 12/1994 | LeBlanc | 405/21 |
| 5,378,088 | A | * | 1/1995 | Foehrkolb | 405/284 |
| 5,480,255 | A | * | 1/1996 | Bernaquez et al. | 405/284 |
| 5,746,545 | A | * | 5/1998 | Parker, Jr. | 405/302.6 |

FOREIGN PATENT DOCUMENTS

| | | | | |
|---|---|---|---|---|
| DE | 224070 | * | 6/1985 | 405/284 |
| DE | 8513539 | * | 8/1985 | 52/DIG. 9 |
| DE | 3829615 | * | 3/1990 | 52/DIG. 9 |
| DE | 44 04 818 | | 8/1995 | |
| DE | 195 10 702 | | 9/1996 | |
| FR | 1 398 975 | | 5/1965 | |
| FR | 2 682 700 | | 4/1993 | |
| FR | 2 772 230 | | 6/1999 | |
| SU | 1395-737 | * | 5/1988 | 405/15 |

OTHER PUBLICATIONS

Article, "Holding up a bank . . . old tires, stacked and filled with dirt", p. 131, Mar. 1976.*

Smoltcyk: "Grundbau–Taschenbuch" 1987, Verlag Für Architektur und Technische Wissenschaften, Berlin, pp. 360–361; 374–375; 384–385.

PCT International Preliminary Examination Report for PCT/AU 98/00302 dated Apr. 23, 1999.

* cited by examiner

*Primary Examiner*—Frederick L. Lagman
(74) *Attorney, Agent, or Firm*—Michael Best & Friedrich LLP

(57) ABSTRACT

A retaining wall system (10) is defined which includes a plurality of tires arranged in a plurality of courses (14). The tires can be offset within the wall and can be cut in various ways to advantageously improve the strength of the wall. In addition, reinforcing (25, 30, 32) formed from tires or conveyor belts can be associated with the wall system to improve the structural stability of the wall.

43 Claims, 13 Drawing Sheets

RETAINING WALL SYSTEM

TECHNICAL FIELD OF THE INVENTION

The present invention relates to retaining walls and methods for forming the same, more particularly, to retaining walls that utilise tyres and conveyor belts in their construction. When the term "retaining walls" is used in this specification, it includes walls used for retaining embodiments, such as in civil engineering applications (eg. road construction, public works etc), but also includes breakwaters and groins, protecting walls, walls in tunnels and at piers, quays, etc.

BACKGROUND OF THE INVENTION

Discarded tyres and conveyor belts from the automotive, mining and aviation industries represent a significant and growing environmental problem, due to difficulties with disposal, environmental breakdown and/or incineration.

Retaining walls formed from tyres are known in the art. For example, U.S. Pat. No. 5,480,255 discloses an impact absorbing barrier for highways, formed from whole tyres and half tyres, and in-filled with sand material. FR 2,682,700 discloses the use of tyres in a retaining wall where one side wall of the tyre has been removed.

U.S. Pat. No. 5,378,088 discloses a retaining wall formed from a plurality of segmented automobile tyres. Side wall segments disposed horizontally form a front row of the wall, and tread segments of the tyres are connected to the side wall segments and extend rearwardly thereform to provide additional support to the front row. However, the method of forming the front row is both complex and time consuming, requiring excessing tyre cutting, the use of rods 17, additional rods 24 and a relatively complex assembly procedure. Furthermore, the tread segments 20 are provided solely to support the front wall and there is no disclosure of the segments providing any reinforcing stability to any fill material that might be arranged behind the front wall.

It would be advantageous if at least preferred embodiments of the present invention provided a retaining wall and a method for forming the same that improves upon, or at least provides a useful alternative to, the retaining walls formed from tyres that exist in the prior art.

SUMMARY OF THE INVENTION

In a first aspect, the present invention provides a retaining wall for retaining an embankment or similar including a plurality of tyres arranged in a plurality of courses adjacent to the embankment and such that a central axis of each tyre is offset from vertical.

An advantage of such a construction is that a sloping embankment can be formed which then provides additional support to the retaining wall, and additional strength.

Typically, each tyre's central axis is offset from vertical at a batter angle ranging from 10' to 20°. Use of this angle has been observed in practice to provide ease of construction of the retaining wall whilst still retaining the advantages of the inclination of the wall.

Adjacent courses can be separated by a fill material, optionally by a distance that is half a tyre in diameter. Alternatively, adjacent courses can abut. Each tyre can at least partially (but typically completely) be filled with a fill material, and further fill material can be used to fill gaps between the tyres, and between the tyres and the embankment.

Typical fill materials include concrete (for example at the lowest course of tyres and at intermittent courses (eg. every alternating course) in the tyre wall construction). Granular or particulate, optionally free draining materials, can also be employed, for example, such as cobble, sand and/or shredded tyre. The use of shredded tyre further assists in the disposal of additional discarded tyres and is thus environmentally advantageous.

Typically at least some, and in some cases all, of the tyres are each cut either:

(a) in a plane between opposing side walls thereof, and can then be arranged in the walls so that both side walls generally face downwards; or alternatively (and/or additionally)

(b) so as to remove a substantial proportion of one of the side walls, so that the tyres are arranged in the wall so that the remaining uncut side wall generally faces downwards.

With option (a), typically a section of the tyre remains uncut to provide a hinge for pivoting of the tyre portions thereabout, thereby increasing the strength of the wall (ie. with each tyre half being attached to another tyre half). Alternatively, in (b), the removed side wall can be arranged in the tyre to be adjacent to the remaining side wall when the tyre is located in the wall. This provides a more stable base in the tyre for the in-fill of material, and optionally allows for the positioning of a liner between the removed and remaining side walls, thereby covering the lower opening of the tyre when arranged in the wall, and making the tyre better capable of retaining fill therein.

Optionally, at least some or all of the tyres are provided with drain holes (eg. drilled therethrough).

In an alternative construction, the retaining wall can be formed from solid tyres (or a mixture of solid and hollow tyres). Suitable solid tyres include discarded forklift tyres and solid tyres from the mining industry. The advantage of using solid tyres is that excessive fill does not need to be employed, and the deformation that can occur with hollow tyre retaining walls is substantially overcome.

Alternatively, the deformation where hollow tyres are employed can also be ameliorated or eliminated by strengthening the tyre tread wall and side wall(s) (eg. by lining the inside of the tread wall with further cut tyre tread—cut to suitable lengths). For example, two additional tread sections can be positioned inside the tyre to abut the inner face of the tyre tread section(with one section being located inside the other). In addition, extra tyre rings (i.e. cut tyre side walls) can be positioned within the hollow tyre prior to filling (for example up to four additional rings can be employed at the base of a hollow tyre). Such arrangements have been found to strengthen hollow tyres in the retaining wall and to prevent deformation, and to also help in disposing of even more waste (second hand) tyres.

In a second aspect of the present invention there is provided a retaining wall for retaining an embankment or similar that is formed from a plurality of tyres wherein at least some of the tyres are each cut;

(a) in a plane between opposing side walls thereof to define two portions, and such that a section of the tyre remains uncut to provide a hinge for pivoting of the tyre portions thereabout, and so that the tyre can be arranged in the wall such that both side walls generally face downwards; and/or (b) to remove a substantial proportion of one of the side walls wherein the removed side wall is arranged in the tyre to be adjacent to the remaining side wall, and the tyres are arranged in the wall so that the remaining uncut side wall generally faces downwards.

Such an arrangement makes for the easy in-filling of each course of tyres when the wall is being constructed (ie. there is little or no upper side wall to deflect fill material being arranged in the tyres). Also, the judicious cutting in this manner can provide a wall that is even stronger than one formed from a number of individual "intact" tyres.

In a third aspect, the present invention provides a retaining wall for retaining an embankment or similar including a reinforcing section extending rearwardly into the wall from an outer portion thereof, the reinforcing section being part of the retaining wall and being formed from:

(a) portions/sections cut from one or more tyres; and/or (b) conveyor belt portions/sections.

The reinforcing section can be used with retaining walls formed with conventional facing materials (eg. concrete or stone). In this case the reinforcing can replace existing reinforcing materials (such as geofabric materials). The reinforcing section can also be used very simply in an earthen batter retaining wall (ie. having no particular facing material other than the earth itself). However, most preferably the reinforcing section is used with a face formed from a plurality of tyres in a plurality of courses (as described below).

Such reinforcing provides a structurally stable retaining wall (and is quite different in function to and simpler than, for example, the arrangement defined in U.S. Pat. No. 5,378,088).

When the wall facing material is formed from tyres and when at least some of the tyres in the wall section have an intact tread, such tyres additionally define an enclosure into which fill material can be arranged. This means that there is no need for the employment of rods or pylons (which are otherwise required in the arrangement shown in U.S. Pat. No. 5,378,088).

Further, because the reinforcing can be constructed essentially from tyres or conveyor belts and fill material, it is simpler and economically more expedient than existing arrangements.

Typically, the reinforcing section is attached to the wall facing structure and may either be formed from a plurality of tread sections, or from a plurality of side wall sections, and optionally (or alternatively) from a plurality of conveyor belt sections. Both the tread sections and side wall sections can be cut from additional tyres, and the conveyor sections can be cut from a single conveyor belt. The sections can then be joined together to define the reinforcing section.

Preferably the sections are joined to define a grid formation, which thereby replaces the existing geogrids used in the prior art. It should be appreciated that prior art geogrids are typically formed from woven and non-woven textiles, optionally reinforced with polymer; or from polymeric fibres. Such geogrids and reinforcing materials tend to be very expensive, whereas the use of tyres and conveyor belts is both environmentally and economically advantageous and, again, is a simpler option.

In the grid formation, individual sections can be attached or linked to and/or threaded through adjacent sections to define the grid formation.

Also, a reinforcing section can be provided for each course and is typically arranged to extend generally horizontally or to be inclined downwardly into the wall.

Each plurality of courses typically defines a "row". Accordingly, in an alternative construction, a plurality of rows of tyres can be arranged adjacent to the embankment.

In a fourth aspect, the present invention also provides a method for forming a retaining wall for retaining an embankment or similar including the steps of:

(a) forming a base for the retaining wall adjacent to the embankment and that slopes downwardly to the embankment from surrounding ground; and (b) arranging a plurality of tyres in a plurality of courses adjacent to the embankment and along the base.

As above, the batter angle of the so-formed wall typically ranges from 10° to 20° offset from the vertical.

Typically, a course of tyres is laid and each tyre is then at least partially (preferably completely) in-filled with the fill material prior to laying the next course.

In addition, each course of tyres can be arranged to be offset (along the line of the course) from adjacent course(s).

In a fifth aspect, the present invention provides a method for forming a retaining wall from a plurality of tyres including the step of cutting at least some of the tyres:

(a) in a plane between opposing side walls thereof, wherein a section of the tyre remains under to provide a hinge for pivoting of the tyre portions thereabout, and than arranging those tyres in the walls so that both side walls generally face downwards; and/or (b) to remove a substantial portion of one of the side walls, with the removed side wall being arranged in the tyre to be adjacent to the remaining side wall, and then arranging those tyres in the wall so that the remaining uncut side wall generally faces downwards.

Such a method is employed with hollow tyres (not solid tyres).

In a sixth aspect, the present invention provides a method for forming a retaining wall for retaining an embankment or similar including the step of positioning in the wall a reinforcing section that is formed from portions/sections cut from one or more tyres or from one or more conveyor belts.

Thus, the method can be used to form any type of retaining wall that requires a reinforcing section, and the advantage is that typical geogrid or geofabric materials used as reinforcing sections can be replaced by sections formed from tyres or conveyor belts.

Preferably a face of the wall is defined by arranging a plurality of elements in a plurality of courses adjacent to the embankment to define the wall face. Such elements can be construction elements used in conventional reinforcing wall faces, such as concrete blocks stone blocks etc. Alternatively, the construction elements can be formed from a plurality of tyres (optionally cut in accordance with the teachings of the present invention).

Typically, the reinforcing section is attached prior to or after the arranging of at least one course of construction elements in a face of the wall.

Also, instead of only using tyres in the reinforcing section (for example discarded tyres) conveyor belts can be employed (especially discarded conveyor belts). For example, nylon woven conveyor belts from the mining industries (being conveyor belts that do not have any steel or metal content) can be employed. Such conveyor belts have a high tensile strength and therefore provide desirable strength characteristics when used as reinforcing in retaining walls.

BRIEF DESCRIPTION OF THE DRAWINGS

Notwithstanding any other forms which fall within the scope of the present invention, preferred forms of the invention will now be described, by way of example only, with reference to the accompanying drawings in which.

NODES FOR CARRYING OUT THE INVENTION

Figure 1:
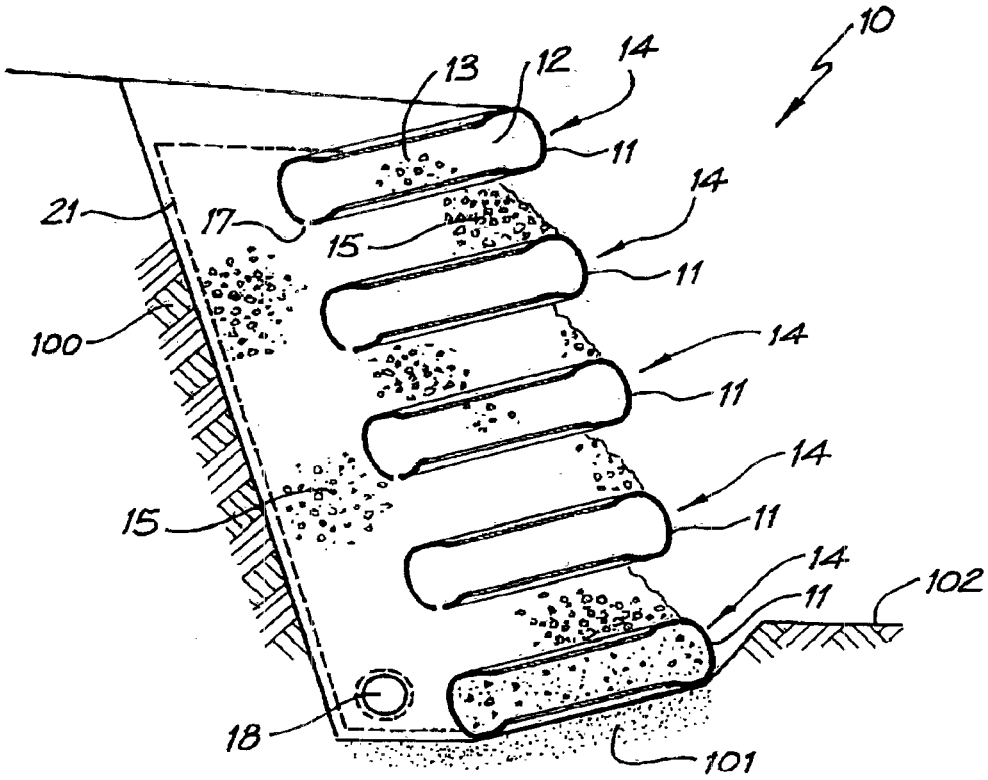
FIG. 1 is a cross-sectional side elevation of a retaining wall according to a first embodiment of the invention.

A preferred embodiment of a retaining wall 10 according to the current invention for retaining an embankment 100 or similar, comprises a plurality of tyres 11 each having a cavity 12 defined therein at least partially filled with a fill material 13. (Alternatively tyres 11 can be solid tyres from forklifts, mining vehicles etc. In this latter case use of less fill material and a more stable wall can result). In the preferred embodiment, each cavity 12 is substantially filled with the fill material 13. The tyres 11 are arranged in a plurality of courses 14 adjacent to the embankment 100. Further fill material 15 substantially fills gaps between each of the tyres 11 and between the tyres 11 and the embankment 100.

The embankment 100 is typically excavated away from ground line 102 to define a wall at an angle to the vertical of approximately 10° to 20°, with the retaining wall 10 similarly having a batter angle of 10° to 20°. In the preferred embodiments depicted, the retaining wall 10 has a batter angle of approximately 14° (eg. the central axis of each tyre in the wall is inclined at 14° with respect to vertical). Taller walls will typically require a larger batter angle for stability, whilst smaller walls can employ smaller batter angles so as to reduce the space occupied by the retaining wall 10. As well as for retaining typical embankments as used in landscaping and the like, retaining walls of the current invention may be used with other embankments including those used as noise barriers or waterway walls (see walls) etc.

Thus, each tyre 11 is typically arranged such that a central axis thereof is offset from vertical at an angle approximately equal to the batter angle. With this incline of the tyres 11 to match the batter angle, the stability of the wall 10 is enhanced by reducing the reliance on friction between the courses 14 of tyres 11 for shear stability. In prior art retaining wall designs where shear stability has not been considered to be of prime concern, the tyres 11 have been laid flat with each subsequent course 14 set back from the adjacent lower course 14 to provide the batter angle of the wall 10.

The tyres 11 are typically arranged such that the tyres 11 of a given course 14 are offset from those of the adjacent lower course 14 in a typical brickwork fashion. In the preferred embodiments depicted, adjacent courses 14 are separated by the further filler material 15, here giving a separation between courses 14 of approximately half a tyre 11 diameter. Alternatively, the tyres 11 of adjacent courses 14 may abut, with the further filler material 15 filling gaps between surfaces of the adjacent tyres 11 which do not abut.

The tyres 11 are also typically separated from the embankment 100 by the further filler material 15. Alternatively the tyres 11 may abut the embodiment 100 with the further filler material 15 filling gaps where the surface of the tyres 11 do not abut the embodiment 100.

Figure 3:
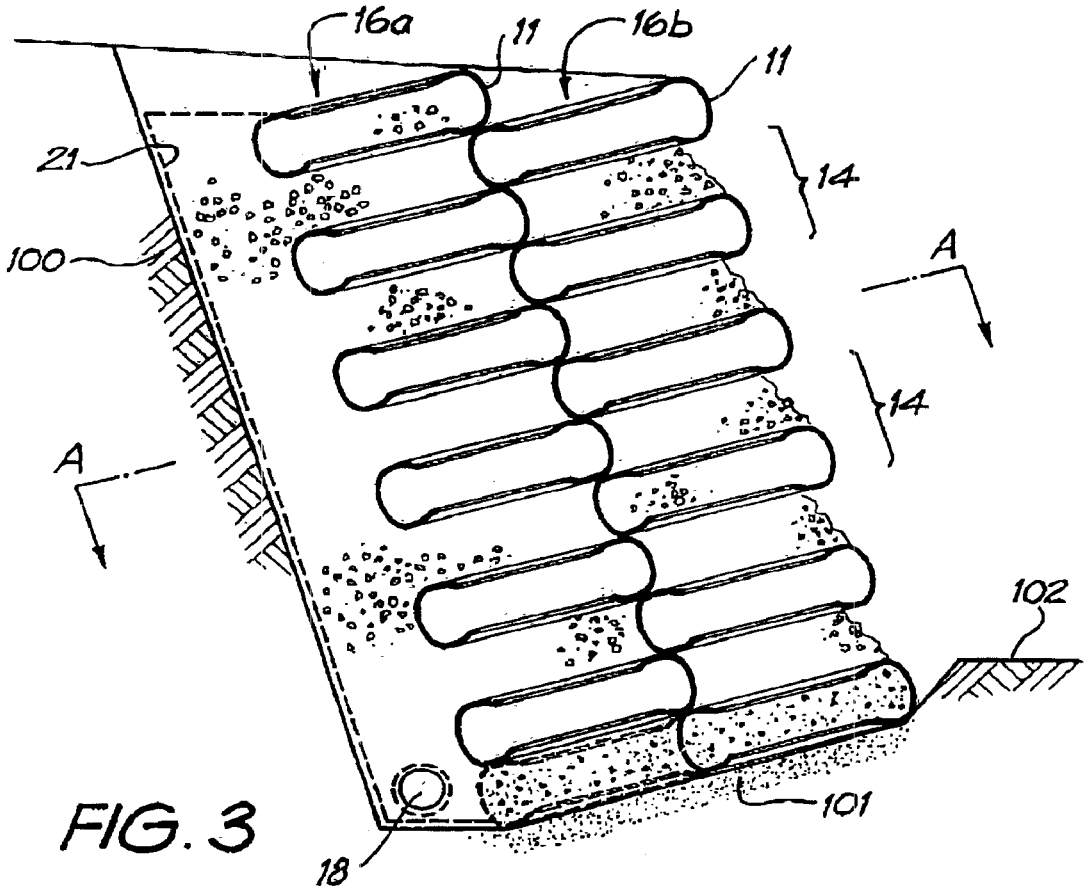
FIG. 3 is a cross-sectional side elevation of an alternative retaining wall according to a second embodiment of the invention.
Figure 4:
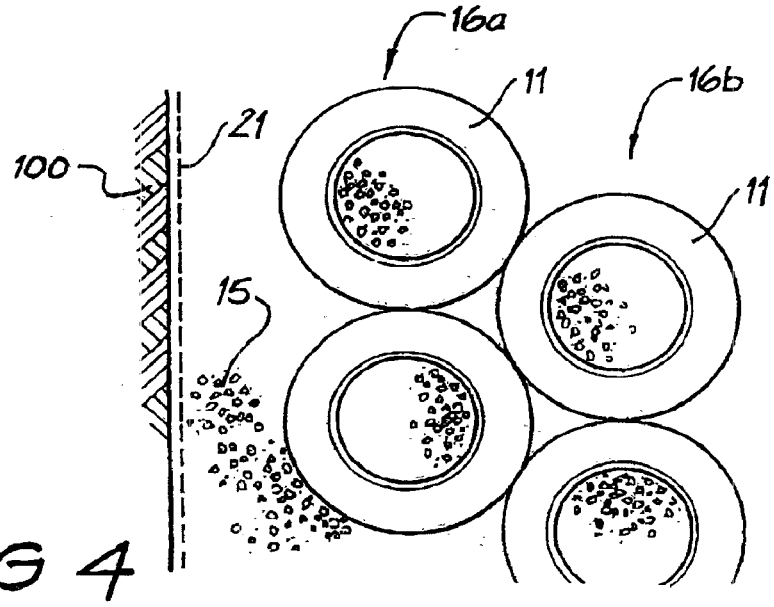
FIG. 4 is a sectional view of the retaining wall of FIG. 3 taken at A—A.

For larger retaining walls as depicted in FIGS. 3 and 4, two rows 16*a,* 16*b* of tyres 11 may be used to complete each course 14. Utilisation of two rows 16*a,*16*b* increases the stability of the retaining wall 10 enabling increased wall height. The adjacent tyres 11 in the two rows 16*a,*16*b* are typically horizontally offset as depicted in FIG. 4 and may also be vertically offset as depicted in FIG. 3.

The foundation 101 for the retaining wall 10 is here excavated below the ground line 102 to help secure the lowermost course 14*a* in place. To further secure the lowermost course 14*a,* the tyres 11 thereof are filled with concrete as the fill material 13 (tyres shown as shaded). A stabilised sand base may be employed for the foundation 101. Alternatively, the foundation can be a concrete base (optionally reinforced). For construction with a waterway wall, where the tyres 10 will act as the interface with the water, every second course of tyres 11 is typically filled with concrete to increase the mass of the wall and thereby reduce any possible instability resulting from wave action.

The fill material 13 typically comprises a free draining material in at least some of the courses 14. Here the fees draining fill material 13 is granular and is used in all but the lowermost course 14*a*. Cobble has been found to be a suitable fill material 13, whilst the use of other free draining materials, including shredded tyres is also desirable. Use of shredded tyres further increases the recyclability of the discarded tyres, but they are typically not used where the wall construction relies on its mass for stability.

The further fill material 15, used to fill gaps between tyres 11 and between the tyres 11 and embankment 100 is also here a free draining granular material such as cobble. To further assist in drainage, drain holes 17 may be provided in the tyre 11, and a socked perforated sub-surface drain 18 or similar may be laid between the lowermost course 14*a* and the embodiment 100.

Figure 2:
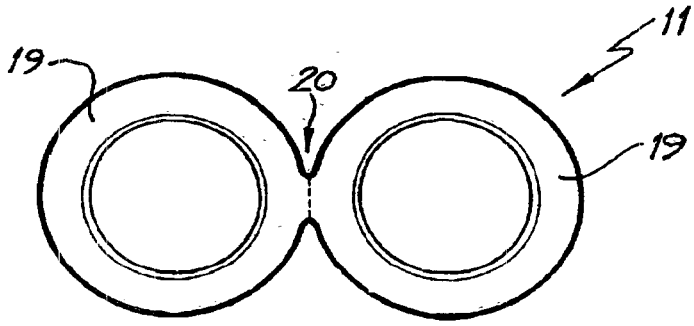
FIG. 2 is a plan view of a tyre cut in a plane between opposing side walls.

FIG. 2 depicts a tyre as used in a preferred embodiment wherein at least some of the tyre 11 are each cut in a plane between opposing sidewalls 19 thereof and arranged with both of the sidwalls 19 facing generally downwards. This results in the inner concave surface of each of the sidewalls 19 facing upwards, facilitating filling of the cavity 12 with fill material 13 in the region of the sidewalls 19. A section 20 of the tyre 11 may remain uncut such that the sidewalls 19 remain hingedly attached at the uncut section 20. Rather than cutting each tyre 11 into opposing halves, the upper sidewall of the tyres 11 may be at least partially removed to facilitate filling of the cavity 12 (see FIGS. 5, 15 and 16).

To increase the stability of the retaining wall 10, the tyres 11 may be secured to each other and, if so desired, to the embankment 100 or foundation 101 with the use of nylon rope or smaller. Reinforcing grids may also be used to secure one or more of the courses 14 of tyres 11 to the embankment 100. Such reinforcing grids typically extend at least approximately 0.7 m into the embankment 100, depending on the wall 10 design, to ensure stability and allow the construction of taller retaining walls 10. The embankment 100 may be compacted to more securely hold the reinforcing grid in place.

To reduce any fire hazard which the use of rubber tyres may pose, the retaining wall 10 as a whole, or each of the tyres 11 individually, may be covered with a fire retardent material or coating. Such a material which may be used is geofabric which is also typically used as a liner 21 between the embankment 100 and the retaining wall 10.

Figure 5:
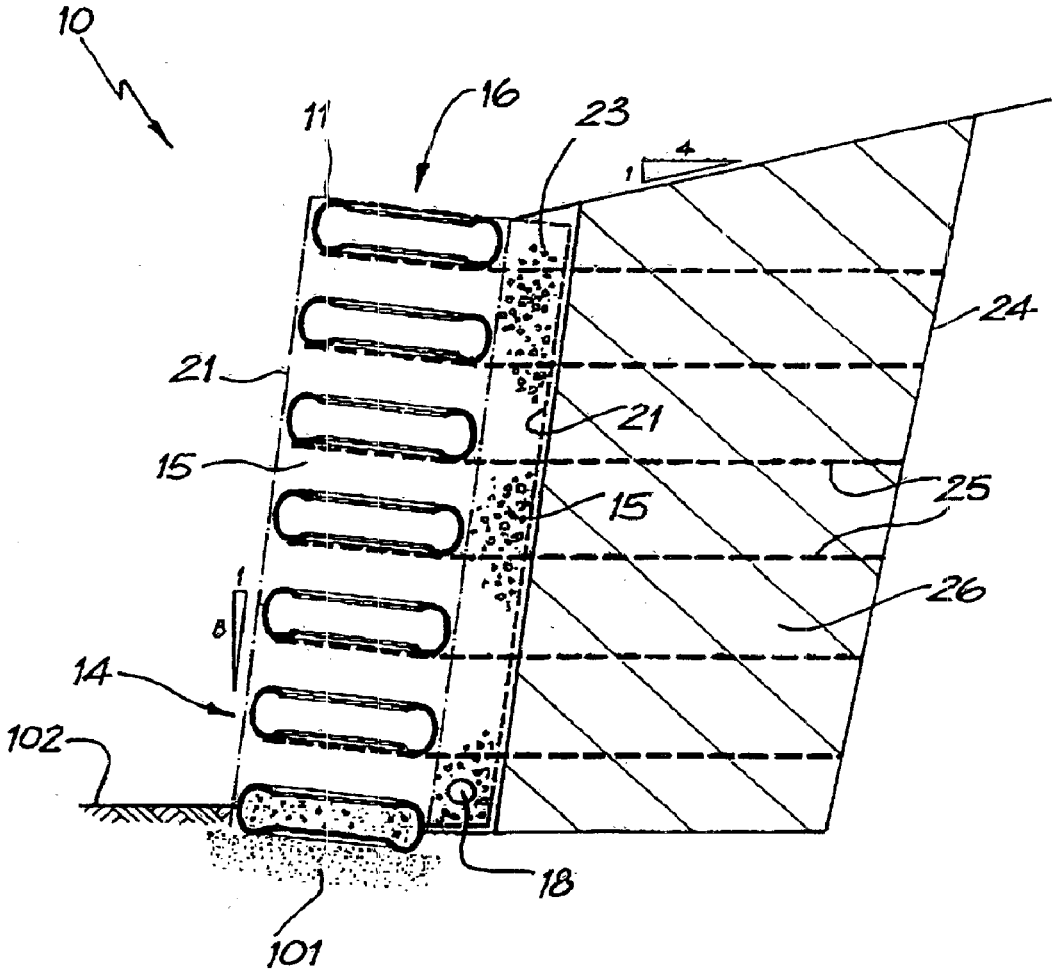
FIG. 5 is a cross-sectional side elevation of an alternative retaining wall according to a third embodiment of the invention.
Figure 6:
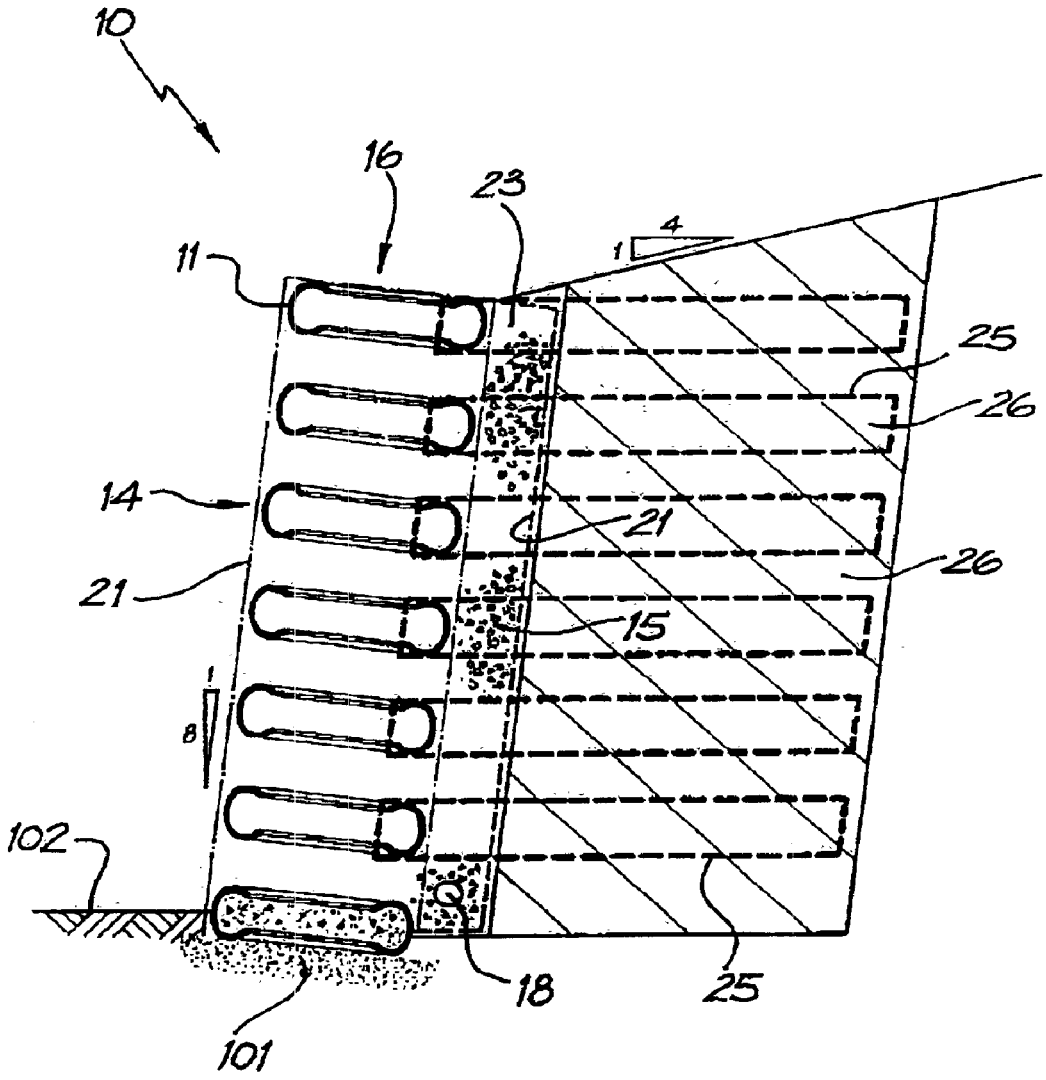
FIG. 6 is a cross-sectional side elevation of an alternative retaining wall according to a fourth embodiment of the invention.
Figure 7:
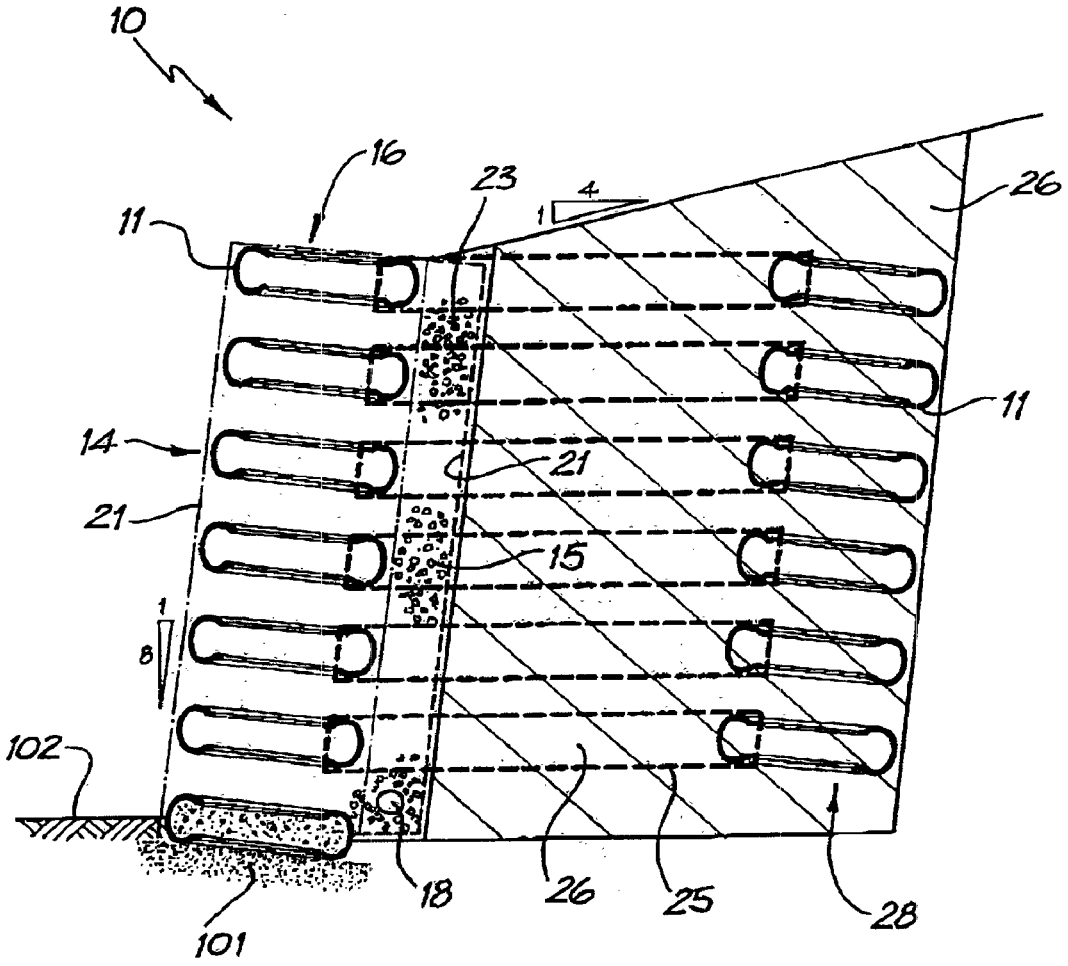
FIG. 7 is a cross-sectional side elevation of an alternative retaining wall according to a fifth embodiment of the invention.

Referring to FIGS. 5 to 7 (where like reference numerals will be used to denote similar or like parts) cross sectional views of various alternative retaining walls are respectively shown.

FIGS. 5 to 7 also show associated desirable slopes of the wall 10 (1 in 8) and the embodiment 24 (1 in 4).

In the embodiment of FIG. 5, a drainage column 23 is provided to extend between the tyre row 16 and the embankment 24. This greatly assists in the release of water trapped in the wall 10. Typically, the drainage layer is defined by cobble backfill (and in preferred embodiments is about 300 mm wide). FIG. 5 also shows reinforcing 25 extending rearwardly from the tyre row 16 and into the embodiment. Whilst conventional reinforcing material such as geofabric (eg geofabric terran 1000) can be used, in accordance with preferred aspects of the present invention the reinforcing is formed from longitudinal rubber strips (eg. defined from cut tyres or conveyor belts) and optionally being formed into grid like networks.

In construction of the wall 10 each tyre has respective reinforcing attached thereto as each course is successively layed (with the attachment of reinforcing being typically by the various attachment mechanisms as described below). During construction of the reinforcing section, controlled select fill 26 is positioned on top of each reinforcing section and is compacted (typically in 200 mm layers to 98 percent of its maximum modified density).

Turning to FIG. 6, the arrangement shown in FIG. 5 has been modified whereby the reinforcing 25 is looped through a respective tyre and the loop is then closed within the embodiment. In other words, fill 26 is positioned inside and outside of the loop and this provides an extremely strong structure (whereby the reinforcing with the fill therein functions like an anchor).

Turning to FIG. 7, a further variation of the looped reinforcing is shown. In this case, a further row of tyres 28 is provided within the embankment itself (and thereby each tyre in row 28 is also filled in with the embankment fill 26). This interred row of tyres enhances the anchor function of the reinforcement and provides an extremely strong support for the outwardly facing row of tyres 16.

The arrangements shown in FIGS. 5 to 7 provide an enhancement over the retaining wall arrangements of FIGS. 1 to 4, and also make better use of discarded tyres and conveyor belts generally.

Figure 8:
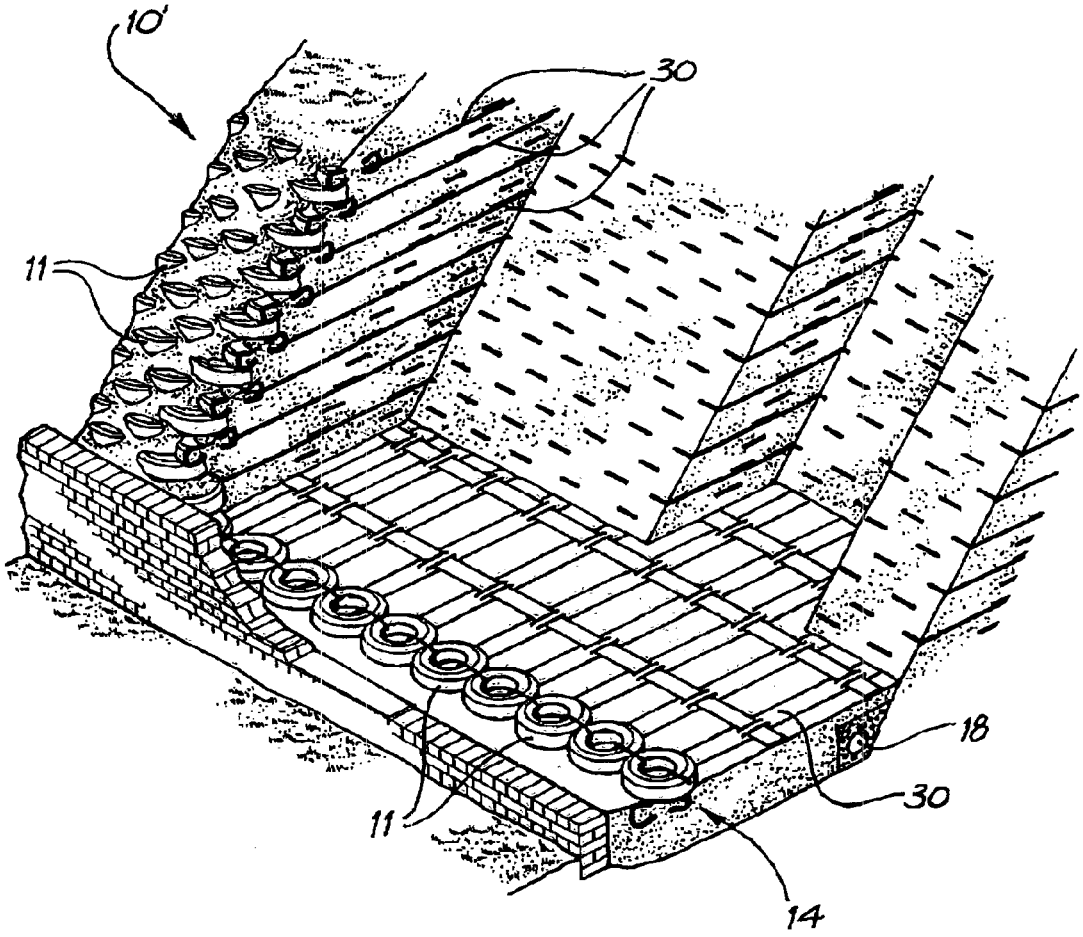
FIG. 8 shows a cross-sectional perspective view of a reinforcing wall constructed in accordance with a preferred method according to the present invention.

Referring now to FIG. 8, an alternative retaining wall 10' in accordance with the present invention will be described. The plurality of tyre courses are essentially the same as either of those described in FIG. 1, or FIGS. 3 and 4. However, the retaining wall of FIG. 5 additionally includes grid-like reinforcing 30 extending from a respective course of tyres and rearwardly into the wall. As each course is successively laid, a respective grid-like reinforcing 30 is laid to extend rearwardly from that course and into the wall.

Once a course of tyres has been placed, the fill of the retaining wall is brought up to an approximate level and the reinforcing grid is then laid onto that fill, before being covered with further fill to lay the next reinforcing grid and so on (ie. the grid can be attached to the tyre in situ by appropriate techniques—described below). Alternatively, the reinforcing grid can be pre-attached to the course of tyres, such that when the course is laid, the grid is simultaneously laid.

The reinforcing grid as shown in FIG. 8 is typically formed from a plurality of tyre treads which are joined end to end and are criss-crossed until the appropriate lengths are achieved. Joining to the tyre courses and of the grid itself can be effected through adhesives, clamps, steel or textile ties, threading, screwing, bolting, etc. Various joining and threading techniques are described below. Each grid can extend generally horizontally into the retaining wall, or can be angled downwardly.

Figure 9:
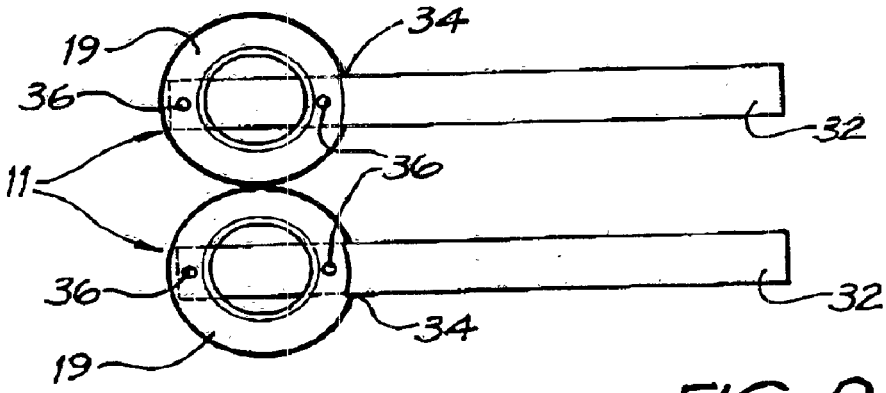
FIG. 9 shows an underside plan view of two tyres of a tyre course, illustrating the mode of attachment of reinforcement for use in a preferred retaining wall.

Referring now to FIG. 9, the attachment of tread lengths 32 to a respective pair of tyres is shown. The tread lengths are fed through a slot 34 formed near the base of each tyre and are then attached to the tyre lower side wall 19 either via screwing (eg. tech screws), bolting, or adhesive 36. Further lengths of tyre tread can then be attached to the free end of length 32 so that a long length of tread extends into the wall (as shown in FIG. 8).

Figure 10:
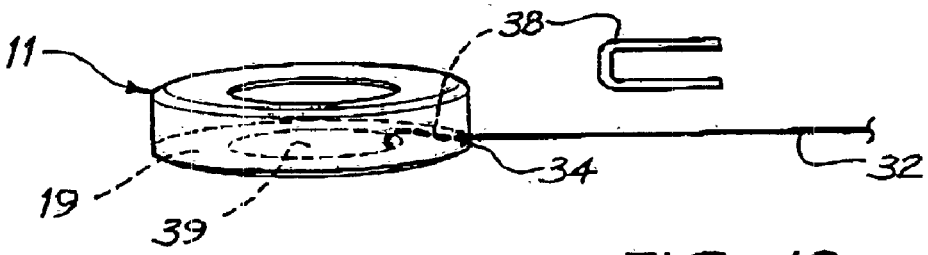
FIGS. 10 and 11 show side schematic elevations of two alternative methods for attaching reinforcing to a tyre.
Figure 11:
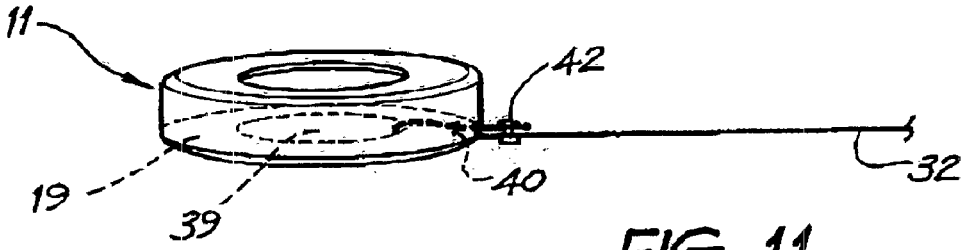

FIGS. 10 and 11 show alternative methods of attaching tread lengths 32 to tyre 11. In FIG. 10, the tread length is either positioned under the tyre, or fed through slot 34 and a clamp 38 then fastens the tread length to the tyre, ie. by clamping around lower side wall 19. The clamp can be formed from stainless steel, aluminum or other deformable metals.

In FIG. 11, the tread length is fed up through tyre hole 39 and looped over the side wall 19 and is then fed back through the tyre side wall 19 via a slot 40 formed in the side wall (or optionally back through slot 34). The tread length is then attached back to itself via a tech screw, bolt, clamp, tie or adhesive 42.

Figure 12:
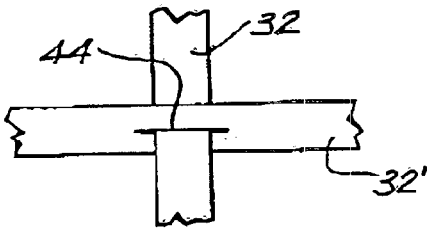
FIGS. 12 and 13 show plan views of two alternative methods for interlocking reinforcing in a reinforcing grid formation according to the invention.
Figure 13:
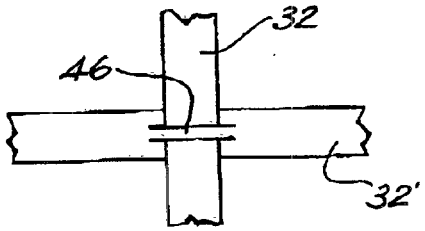

Referring now to FIGS. 12 and 13, two alternative techniques for forming the grid 30 are shown. In FIG. 12, tread length 32 is threaded through tread length 32' via a slot 44 formed in tread 32'. In FIG. 13, tread length 32 is slotted through an arch 46, that is formed by cutting two slots in tread length 32' and then stretching the arch upwardly and sliding the tread length 32 therethrough.

Figure 14:
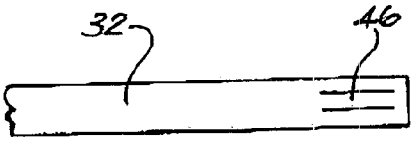
FIGS. 14 to 16 show components of reinforcing, prior to being attached in the manner shown in perspective in FIG. 17.
Figure 16:
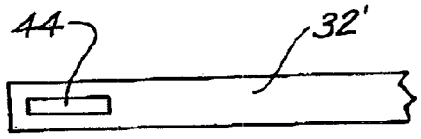
Figure 15:
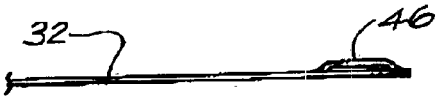
Figure 17:
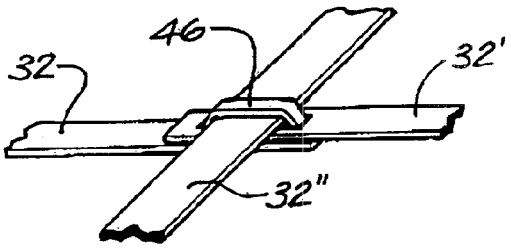

In FIGS. 14 and 15 (which show plan and side elevations respectively of the end of the tread length 32), the arch 46 is formed near one end of the length. In FIG. 16, the slot 44 is formed near the end of another tread length 32'. In FIG. 17, the arch 46 is extended through slot 44 and a third tread length 32" is then slotted under the arch 46. Thus, this arrangement has the dual function of attaching tread length 32 to tread length 32' whilst also enabling the formation of a criss-cross with tread length 32".

The grid-like reinforcing can also be formed from type side walls 30' (or combinations of tread lengths with type side walls).

Figure 18:
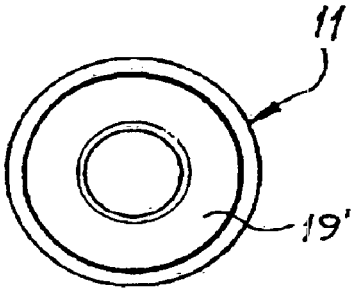
FIGS. 18 and 19 show respectively plan and perspective view of a tyre with a side wall removed therefrom.

FIG. 18 shows a plan view of a tyre 11 that has had its upper side wall 19 removed therefrom. The upper side wall 19 can be arranged inside tyre 11 and adjacent to lower side wall 19'. A liner cut to appropriate shape (eg. formed from a woven geogrid textile) can then be arranged between the upper and lower side walls when the tyre forms part of a retaining wall structure. Optionally, the upper side wall can be attached to the lower side wall.

The arrangement of the liner in this manner functions to provide an enclosed receptacle for receiving fill material therein. Typically, the liner is a non-perishable, nylon, free draining and optionally uv-resistant material.

Figure 19:
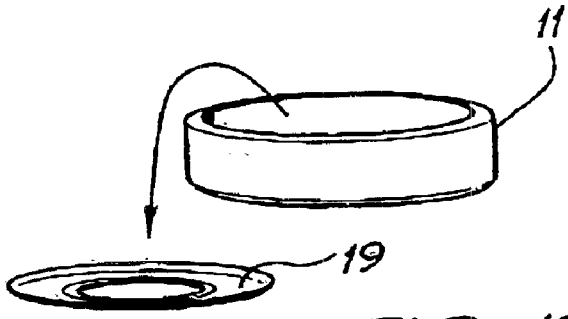
Figure 20:
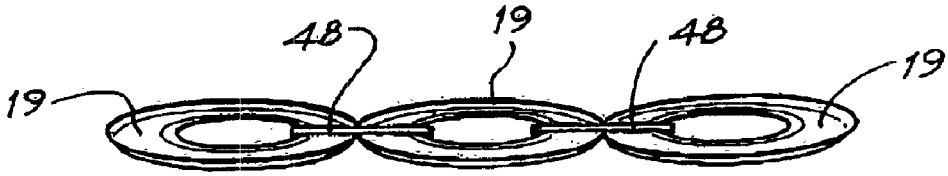
FIG. 20 shows a line of tyre side walls, and tied together being an alternative type of reinforcing according to the invention.

FIG. 19 shows a perspective side elevation of the tyre 11 with its upper side wall removed and FIG. 20 shows three such removed tyre side walls laid in a row, and attached together by ties 48 (eg. textile or metallic ties or clamps etc). The line of tyre side walls, can also be laid underneath a course of "whole" tyres in the retaining wall construction, thereby creating extra friction and lateral stability in the retaining wall. Alternatively, a grid formation can be made by attaching together a plurality of tyre side walls.

Figure 21:
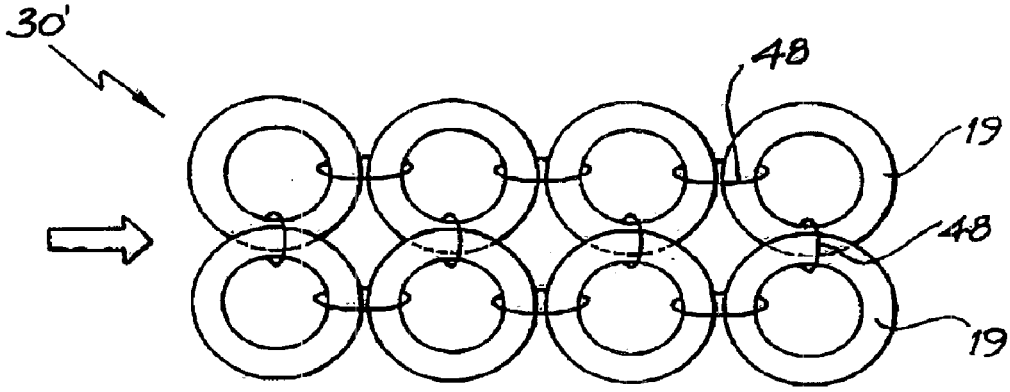
FIGS. 21 to 25 show various tyre side wall reinforcement arrangements.

FIGS. 21 to 25 show various tyre side wall reinforcing type grids. In FIG. 21, the tyre side walls overlap along line A, and are attached together by varying size ties 48 and 48'.

Figure 22:
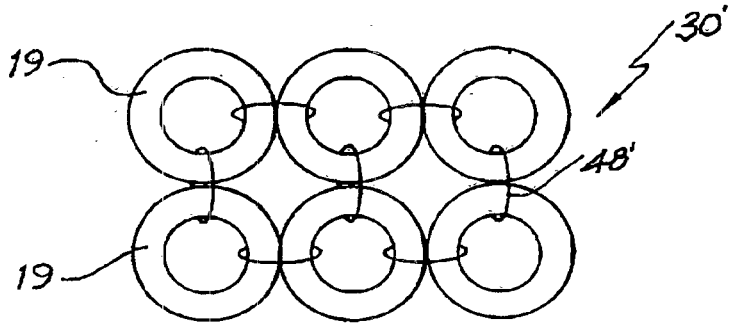

In FIG. 22, none of the side walls overlap and thus, the one size tie 48' can be used.

Figure 23:
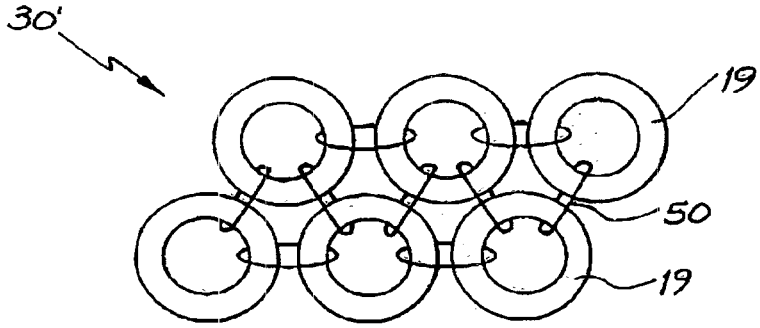

FIG. 23 shows an offset configuration where a tie clamp 50 is used to maintain the configuration.

Figure 24:
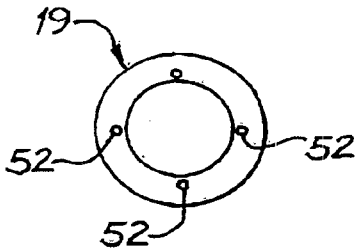
Figure 25:
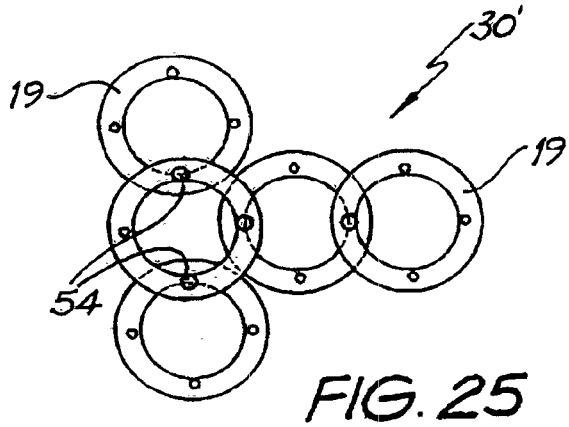

FIG. 24 shows a tyre side wall having a plurality of holes 52 formed (eg. drilled) therethrough. The side walls can than be overlapped as shown in FIG. 25 and fastened together at fastening points 54 (eg. via a cable tie, bolt, screw etc).

Various other configurations of the grid-like reinforcing formed from the plurality of tyre side walls are possible. As with the arrangement of FIG. 8, the reinforcing can be attached to a respective tyre course 14 prior to the laying of the course or subsequent to the laying of the course.

Figure 26:
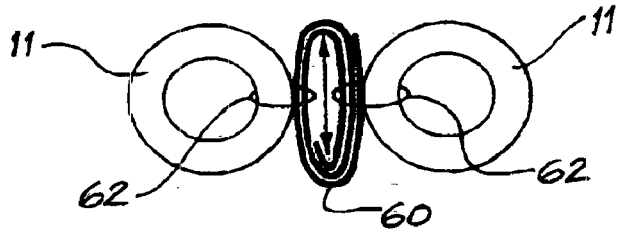
FIG. 26 shows an arrangement in plan for a pair of tyres, typically employed at a retaining wall edge or corner.

FIG. 26 shows a pair of tyres 11 having a roll of tyre tread 60 positioned therebetween and clamped to each tyre via claims 62. This arrangement is typically employed with tyres at the corner of a retaining wall to give those tyres extra strength and to build stability and also extra impact resistance (eg. as provided by the tyre tread roll). Such an arrangement also helps in maintaining the height of the course at the corner (ie. preventing sagging).

Figure 27:
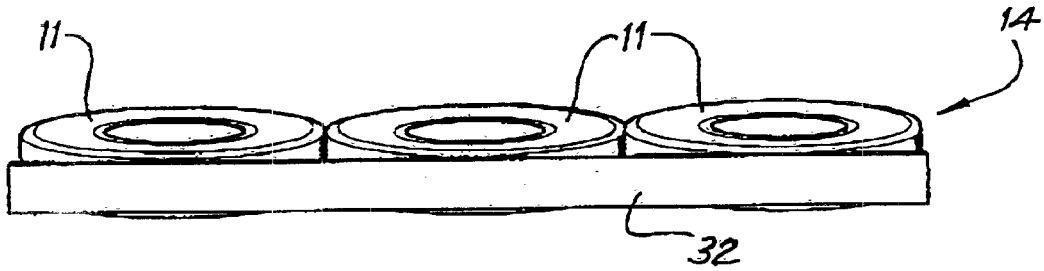
FIG. 27 shows a perspective view of a tyre facing, for rendering a course of tyres suitable for receiving a fabric or textile coating.

FIG. 27 shows a line of tyres 11 in a course 14, and having a tread length 32 attached to the front (and/or rear) face of the course. The tyre length can be attached via screws, clamps, adhesives etc. Such an arrangement provides a flat surface along the course, which is far more receptive for fabric and/or textile coatings (eg. geofabrics) often employed in retaining walls.

Figure 28:
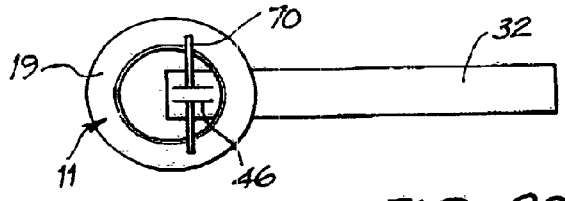
FIGS. 28 to 30 show further alternative means of attaching tyre treads to whole tyres.
Figure 29:
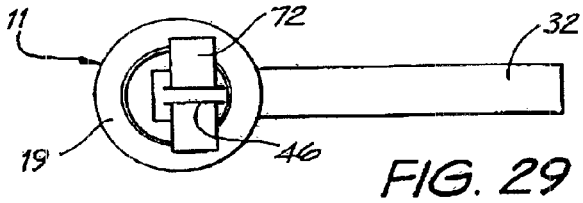

Referring to FIG. 28, an alternative mechanism for attaching a tread section 32 to a tyre is shown. In the arrangement of FIG. 28, a bar or rod 70 (optionally of galvanised steel or fibreglass) is inserted through a slot 46 and is then positioned above the upper side wall of an uncut tyre 11. The pressure of the fill and other courses on top of this arrangement ensures its structural stability. Similarly, in FIG. 29, a section of tread 72 is slotted through slot 46 to achieve a similar effect to the arrangement of FIG. 28.

Figure 30:
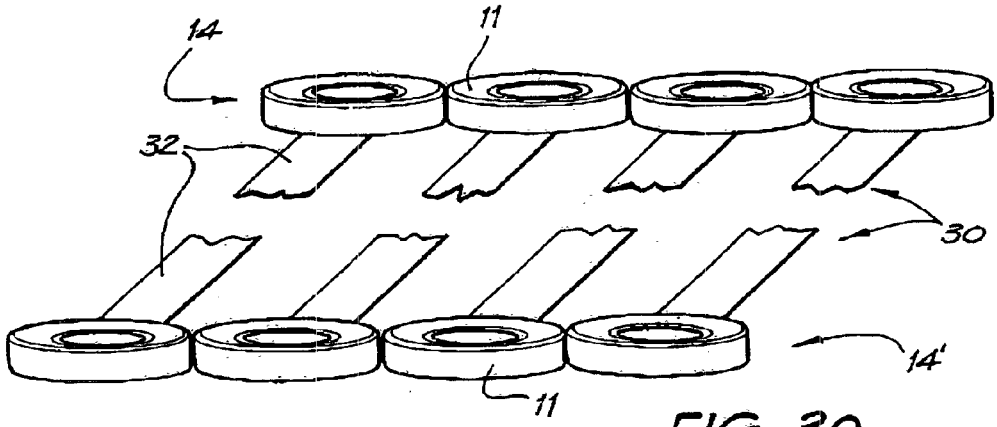

Referring to FIG. 30, a so-called "dead man" configuration is shown (similar to that shown in FIG. 7), primarily to provide an anchoring and tensioning aid to the reinforcing grid 30. Essentially, a course of tyres 14' for each reinforcing grid 30 is laid adjacent to the embankment (to be enclosed within the retaining wall when finally constructed). That course of tyres is thus connected to the free ends of the retaining grid which, at their opposing ends, are attached to the course of tyres 14 (ie. at the front of the retaining wall). The course of tyres at the rear of the grid aid in the strength of the entire retaining wall, and also assist in tensioning of the retaining grid (ie. when the course 14' is pulled or urged rearwardly).

Figure 31:
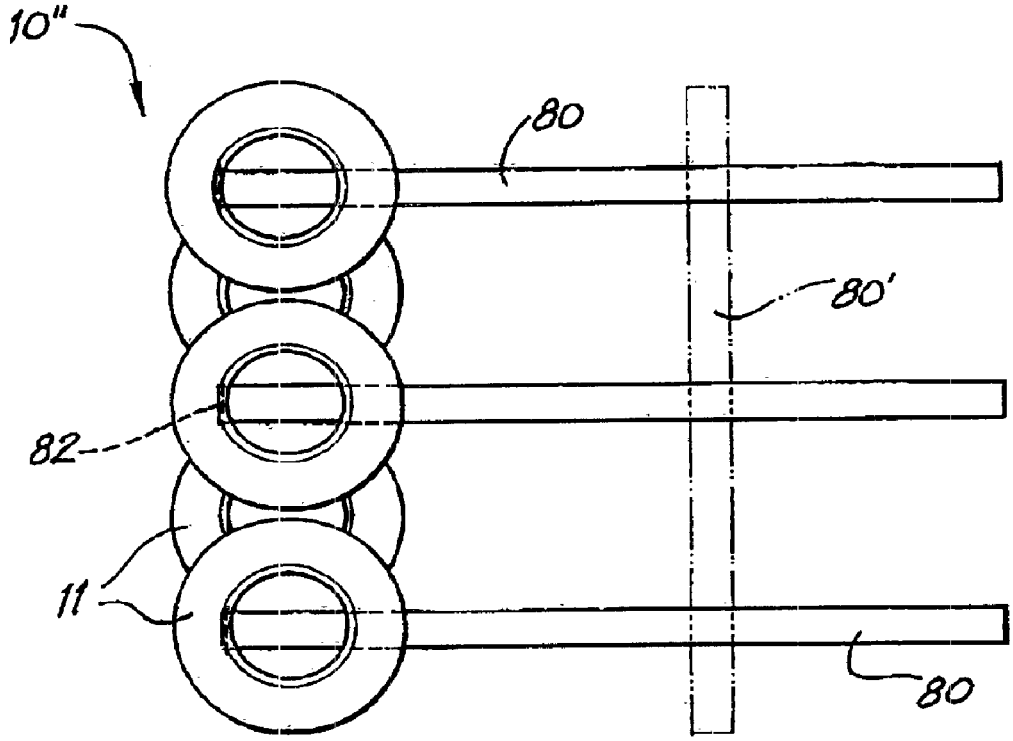
FIGS. 31 and 32 show, respectively, plan and side elevations of a further preferred embodiment in which reinforcing is provided by conveyor belts.
Figure 32:
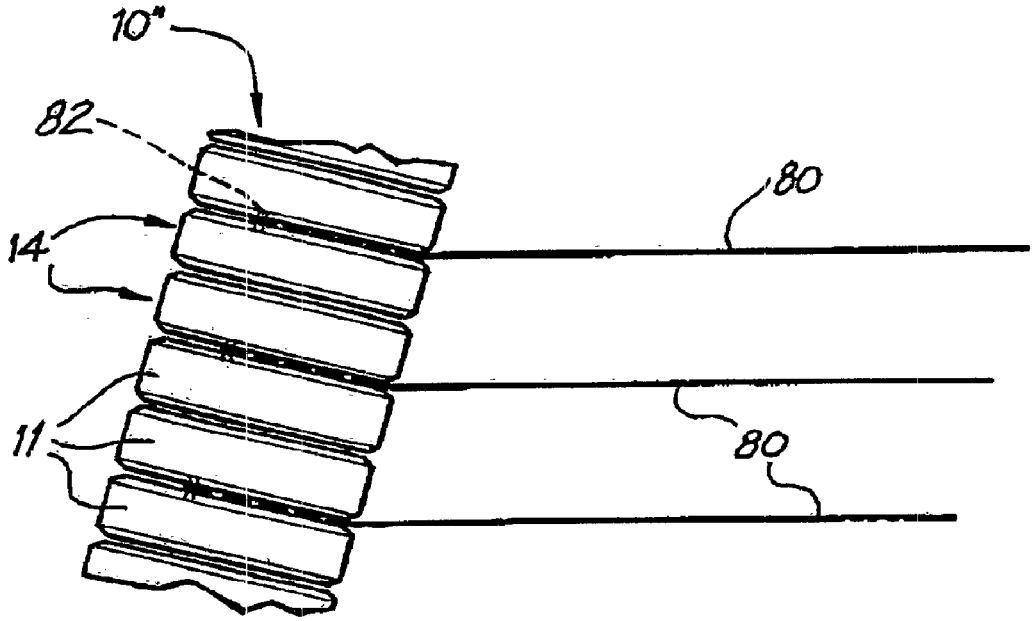

Referring to FIGS. 31 and 32, a retaining wall 10' formed from a plurality of tyres 11 has a similar batter angle to that shown in FIG. 1. The construction of the retaining wall is similar to that previously described for FIGS. 1 to 8.

However, rather than employing reinforcing formed from cut tyres, conveying belt strips 80 can be employed.

Typically conveyor belt strips that are 200 to 300 millimetres wide, and that are discarded by the mining industries are employed. Such strips are typically formed from a high tensile strength, nylon woven conveyor belt, and typically strips that do not have any metal content (e.g., steel which would otherwise corrode within the wall) are employed.

As can be seen in FIGS. 31 and 32, each strip extends between tyre courses 14, and is typically attached to beading 82 on a front section of the tyre.

The conveyor belt strip is typically connected to the beading using a proprietary conveyor belt connection (e.g., a 20 KN working cap).

The conveyor belt strips can also include cross strips 80', so that a grid formation (as previously described) is formed.

Typically the conveyor belts are attached to the tyres, although in some circumstances, the conveyor belt strips can simply lie adjacent to the tyre wall without being attached thereto.

One advantage with conveyor belt strips is that they generally come in very long lengths, and therefore there is no need to join lengths of strip together to form an elongate section extending into the wall. This is also advantageous when a grid like criss-crossing formation in the reinforcing is employed. The conveyor strips can also be threaded, and linked etc. as defined above.

As shown in FIG. 32, the strips can extend generally horizontally into the reinforcing portion of the wall, or alternatively they can be arranged to extend downwardly (inclined) into the wall.

As with the tyre section reinforcing, the conveyor belt strips can be anchored at their remote end, and in fact all of the arrangements and modes of attachment described above for the tyre sections can be equally employed with the conveyor belt sections (and thus will not be described again).

Engineering analysis has indicated that retaining walls in accordance with the present invention compare favourably with current typical retaining walls such as timber crib, concrete crib or segmental brickwork walls, whilst generally being less expensive, lighter in weight, and providing a solution to the problem of discarded tyre and conveyor belt disposal.

Whilst the invention has been described with reference to a number of preferred embodiments, it should be appreciated that the invention can be embodied in many other forms.

What is claimed is:

1. A retaining wall for retaining an embankment or similar structure that is formed from a plurality of tyres arranged in a plurality of courses adjacent to the embankment wherein at least some of the tyres are each cut:

(a) in a plane between opposing side walls thereof and such that a section of the tyre remains uncut to provide a hinge for pivoting of the tyre portions thereabout, and so that the tyre can be arranged in the wall such that both side walls generally face downwards; or (b) to remove a substantial proportion of one of the side walls wherein the removed side wall is arranged in the tyre to be adjacent to the remaining side wall, and the tyres are arranged in the wall so that the remaining uncut side wall generally faces downwards.

2. A retaining wall as claimed in claim 1 wherein in (b), a liner is positioned between the removed and remaining side walls to cover the lower opening of the tyre when arranged in the wall.

3. A retaining wall as claimed in claim 1 or claim 2 wherein the cut tyres are substantially filled with fill material in the finished retaining wall.

4. A retaining wall as claimed in claim 2 wherein the course of the retaining wall are arrayed in a plurality of course adjacent to the embankment wherein at least some of the tyres are each cut:

(a) in a place between opposing side walls thereof and such that a section of the tyre remains uncut to provide a hinge for pivoting of the tyre portions thereabout, and so that the tyre can be arranged in the wall such that both side walls generally face downwards; or (b) to remove a substantial proportion of one of the side walls wherein the removed side wall is arranged in the tyre to be adjacent to the remaining side wall, and the tyres are arranged in the wall so that the remaining uncut side wall generally faces downwards.

5. A retaining wall for retaining an embankment or similar structure including:

an outer portion formed from a plurality of tyres that are arranged adjacent to the embankment with the tyres in the outer portion having an intact tread; a reinforcing section extending rearwardly into the wall from the outer portion and being formed from:

(a) longitudinal strips formed from tyre treads; or (b) conveyor belt lengths.

6. A retaining wall for retaining an embankment or similar structure including a reinforcing section extending rearwardly into the wall from an outer portion thereof, the reinforcing section being part of the retaining wall and being formed from:

(a) longitudinal strips formed from tyre treads; or (b) conveyor belt lengths;

wherein the treads or belt lengths are joined to define a grid formation.

7. A retaining wall as claimed in claim 6 wherein the reinforcing section is attached to the outer portion of the wall.

8. A retaining wall as claimed in either claim 6 or claim 7 wherein the reinforcing section is formed by joining together a plurality of tyre tread lengths and conveyor belt lengths.

9. A retaining wall as claimed in claim 6 or 5 wherein said individual belt lengths are attached, linked, or threaded to/through adjacent belt lengths to define the grid formation.

10. A retaining wall as claimed in claim 6 or 5 wherein the reinforcing section is formed from a plurality of sections cut from mining conveyor belts.

11. A retaining wall as claimed in claim 6 wherein the outer portion of the wall is formed from a plurality of elements that are arranged in a plurality of courses adjacent to the embankment and a reinforcing section is provided for each course and is arranged to extend generally horizontally or to be downwardly inclined in the wall.

12. A retaining wall as claimed in any one of the claim 11, 13, or 14 wherein the plurality of courses define a row and wherein a plurality of rows are arranged adjacent to the embankment.

13. A retaining wall as claimed in claim 6 wherein the outer portion of the wall is formed from a plurality of tyres that are arranged in a plurality of courses adjacent to the embankment, with at least some of the tyres in the outer portion of the wall having an intact tread portion.

14. A retaining wall as claimed in claim 6 wherein the outer portion of the wall is formed from a plurality of tyres arranged in a plurality of courses in a manner as described in claim 1.

15. A method for forming a retaining wall for retaining an embankment or similar comprising the steps of:

(a) forming a base for the retaining wall adjacent to the embankment and that slopes downwardly to the embankment from surrounding ground; and (b) arranging a plurality of tyres in a plurality of courses adjacent to the embankment and along the base, such that a central axis of each tyre in the retaining wall is inclined in both vertical and horizontal.

16. A method as claimed in claim 15 wherein the base is formed to provide an incline in the wall to vertical, at a batter angle of 10° to 20°.

17. A method as claimed in claim 16 wherein a central axis of each tyre in the wall is inclined from vertical at an angle that is approximately equal to the batter angle.

18. A method as claimed in claim 17 wherein each course of tyres is arranged to be offset along the line of the course from adjacent course(s).

19. A method as claimed in claim 16 wherein in step (b) a course of tyres is laid and each tyre is at least partially in-filled with a fill material prior to laying the next course.

20. A method as claimed in claim 19 wherein each tyre in a course is filled such that:

tyre(s) in the next course abut that tyre; or tyre(s) in the next course are separated by the fill material from that tyre.

21. A method as claimed in claim 19 wherein during filling of each course, additional fill material is provided to fill gaps between tyres, and between the tyres and the embankment.

22. A method as claimed in claim 15 wherein the arranging step (b) includes placing the tyres along the base with central axis of each tyre in an outer face of the retaining wall being inclined to both vertical and horizontal.

23. A method for forming a retaining wall for retaining an embankment or similar structure comprising the steps of:

(a) forming a base for the retaining wall adjacent to the embankment and that slopes downwardly to the embankment from surrounding ground;

(b) arranging a plurality of tyres in a plurality of courses adjacent to the embankment and along the base, wherein, prior to laying a course, at least some of the tyres in the course are each cut:

(i) in a plane between opposing side walls thereof and are arranged in the walls so that both side walls generally free downwards; or (ii) to remove a substantial proportion of one of the side walls, and are arranged in the wall so that the remaining uncut side wall generally faces downward.

24. A method as claimed in claim 23 wherein in (i), a section of the tyre remains uncut to provide a hinge for providing of the tyre portions thereabout.

25. A method as claimed in claim 23, wherein in (ii) the removed side wall is arranged in the tyre to be adjacent to the remaining side wall when the tyre is located in the wall.

26. A method as claimed in claim 25 wherein a liner is positioned between the removed and remaining side walls to cover the lower opening of the tyre when the tyre is arranged in the wall.

27. A method for forming a retaining wall from a plurality of tyres comprising the step of cutting at least some of the tyres:

(a) in a plane between opposing side walls thereof, wherein a section of the tyre remains uncut to provide a hinge for pivoting of the tyre portions thereabout, and then arranging those tyres in the wall so that both side walls generally face downwards; or (b) to remove a substantial portion of one of the side walls, with the removed side wall being arranged in the tyre to be adjacent to the remaining side wall, and then arranging those tyres in the wall so that the remaining uncut side wall generally faces downwards.

28. A method as claimed in claim 27 wherein in (b), a liner is positioned between the removed and remaining side walls to cover the lower opening of the tyre when it is arranged in the wall.

29. A method as claimed in claim 27 or claim 28 wherein the cut tyres are substantially filled with a fill material in the finished retaining wall.

30. A method as claimed in claim 27 wherein a plurality of tyre courses are constructed in accordance with the method as defined in claim 15.

31. A method for forming a retaining wall for retaining an embankment or similar structure including the step of positioning in the wall a reinforcing section that is formed from:

(a) longitudinal strips formed from tyre tread; or (b) one or more conveyor belt lengths;

wherein each of the reinforcing section is formed into a grid structure by joining together a plurality of tyre tread lengths or conveyor belt lengths.

32. A method as claimed in claim 30 wherein an outer face of the wall is defined by arranging a plurality of elements in a plurality of courses adjacent to the embankment to define the face.

33. A method as claimed in claim 32 wherein, prior to or after the arrangement of each course, a reinforcing section is attached to that course.

34. A method as claimed in claim 33 wherein the elements are tyres.

35. A method as claimed in claim 34 wherein at least some of the tyres have an intact tread portion.

36. A method as claimed in claim 32 wherein the elements are tyres.

37. A method as claimed in claim 36 wherein at least some of the tyres have an intact tread portion.

38. A method as claimed in claim 32 wherein the outer face of the wall is formed by using a method comprising the steps of:

(a) forming a base for the retaining wall adjacent to the embankment and that slopes downwardly to the embankment from surrounding group; and (b) arranging a plurality of tyres in a plurality of courses adjacent to the embankment and along the base.

39. A tyre for use in a retaining wall, the tyre being cut:

(a) in a plane between opposing side walls thereof and such that a section of the tyre remains uncut to provide a hinge for pivoting of the resulting tyre portions thereabout, and so that the tyre can be arranged in the wall such that both side walls generally face downwards; or (b) to remove a substantial proportion of one of the side walls wherein the removed side wall is arranged in the tyre to be adjacent to the remaining side wall, so that the tyre can be arranged in the wall so that the remaining uncut side wall generally faces downward.

40. A tyre as claimed in claim 39 wherein (b) a liner is positioned between the removed and remaining side walls for covering the lower opening of the tyre when arranged in the wall.

41. A retaining wall for retaining an embankment or similar structure including a plurality of tyres arranged in a plurality of courses adjacent to the embankment and such that a central axis of each tyre in an outer face of the retaining wall is inclined to both vertical and horizontal, wherein at least some of the tyres are each cut to remove a substantial proportion of one of the side walls and are arranged in the wall so that the remaining uncut side wall generally faces downwards and wherein the removed side wall is arranged in the tyre to be adjacent to the remaining side wall when the tyre is located in the wall.

42. A retaining wall as claimed in claim 41, wherein a liner is positioned between the removed and remaining side walls to cover the lower opening of the tyre when arranged in the wall.

43. A retaining wall for retaining an embankment or similar structure including a plurality of tyres arranged in a plurality of courses adjacent to the embankment and such that a central axis of each tyre in an outer face of the retaining wall is inclined to both vertical and horizontal, wherein at least some of the tyres are each cut in a plane between opposing side walls thereof and are arranged in the wall so that both side walls generally face downwards and wherein a section of the tyre remains uncut to provide a hinge for pivoting of the tyre portions thereabout.

* * * * *